United States Patent [19]

Dick

[11] 4,106,009

[45] Aug. 8, 1978

[54] SINGLE SUBSTRATE AC PLASMA DISPLAY

[75] Inventor: George Wilmer Dick, Colts Neck, N.J.

[73] Assignee: Bell Telephone Laboratories, Incorporated, Murray Hill, N.J.

[21] Appl. No.: 759,892

[22] Filed: Jan. 17, 1977

[51] Int. Cl.[2] ..... H01J 17/48

[52] U.S. Cl. ..... 340/343; 313/518; 340/336

[58] Field of Search ..... 313/217, 514, 517, 518; 340/336, 343, 344

[56] References Cited

U.S. PATENT DOCUMENTS

| | | | |
|---|---|---|---|
| 3,703,657 | 11/1972 | Shesser | 315/169 TV |
| 3,760,403 | 9/1973 | Kippenhan | 340/336 |
| 3,811,061 | 5/1974 | Nakayama et al. | 313/518 |
| 3,935,494 | 1/1976 | Dick et al. | 313/217 X |
| 3,993,921 | 11/1976 | Robinson | 313/217 X |
| 4,019,086 | 4/1977 | Person et al. | 313/518 |

OTHER PUBLICATIONS

George W. Dick and Martin R. Biazzo; "A Planar Single-Substrate AC Plasma Display;" IEEE Transactions on Elec. Dev.; Apr. 1976, pp. 429–437.

*Primary Examiner*—David L. Trafton
*Attorney, Agent, or Firm*—Ronald D. Slusky

[57] ABSTRACT

It has been discovered that the electric field created at an ON site of a planar ac plasma display device in response to the combined sustain and wall voltages propagates along the cathodic electrode during each half cycle of the sustain signal. This means that the electrodes can be made to extend much farther away from the interelectrode gap than was heretofore believed, providing glow paths which extend farther away from the interelectrode gap than have been heretofore provided. Illustrative display devices taking advantage of this discovery include a seven-segment display in which each segment comprises a central electrode and two outer electrodes, and fixed-format displays in which each electrode is formed in the shape of an alphabetic character.

15 Claims, 15 Drawing Figures

SINGLE SUBSTRATE AC PLASMA DISPLAY

BACKGROUND OF THE INVENTION

The present invention relates to plasma display devices.

A plasma display device is comprised of a body of ionizable gas sealed within a nonconductive, usually transparent, envelope. Alphanumerics, pictures and other graphical data are displayed by controllably initiating and quenching glow discharges at selected locations within the display gas. This is accomplished by establishing electric fields within the gas via appropriately arranged electrodes, or conductors.

The present invention more particularly relates to so-called ac plasma panels in which the electrodes are insulated from the display gas. There are two basic types of ac plasma panels, twin substrate and single substrate. The former have electrodes embedded within dielectric layers disposed on two opposing nonconductive surfaces, such as glass plates. Most commonly, the electrodes are arranged in rows on one plate and columns orthogonal thereto on the other. The overlappings, or crosspoints, of the row and column electrodes define a matrix of display sites, or cells. Each display site can be individually switched between ON (energized, light emitting) and OFF (de-energized non-light emitting) states in response to voltages applied between its electrode pair. Other twin substrate electrode arrangements, e.g., multiple segment characters, are possible.

Single substrate ac plasma panels, by contrast, have all electrodes disposed on a single one of the surfaces. The electrodes may, for example, be located at different levels within the dielectric layer disposed on that one surface. Glow discharges are then initiated in response to fringing fields appearing in the gas in the general region of overlapping insulated electrode pairs. Alternatively, electrodes of various geometries may be positioned at a single level, or plane, within the dielectric. With this "planar" geometry, discharges occur in response to fields appearing in the gas in the general region of neighboring pairs of electrodes.

SUMMARY OF THE INVENTION

The present invention is directed to improvements in planar single substrate ac plasma display panels, i.e., the last of the above-mentioned types. It has been heretofore believed in the art that the electric fields created in response to voltages applied to a pair of planar ac plasma panel electrodes remain centered at the dielectric gap between them. This places a theoretical upper limit on the maximum distance away from the gap at which a glow discharge can be expected to be created. I have discovered, however, that once a glow discharge is initiated, the center of the field causing the discharge shifts, or propagates, away from the gap along the cathodic electrode. This means that the electrodes can be made to extend very much farther away from the inter-electrode gap than has been heretofore supposed, providing long "glow paths" which can be used to advantage in fabricating, for example, alphanumeric displays.

BRIEF DESCRIPTION OF THE DRAWING

The invention may be clearly understood from a consideration of the following detailed description and accompanying drawing in which.

DETAILED DESCRIPTION

Figure 1A:
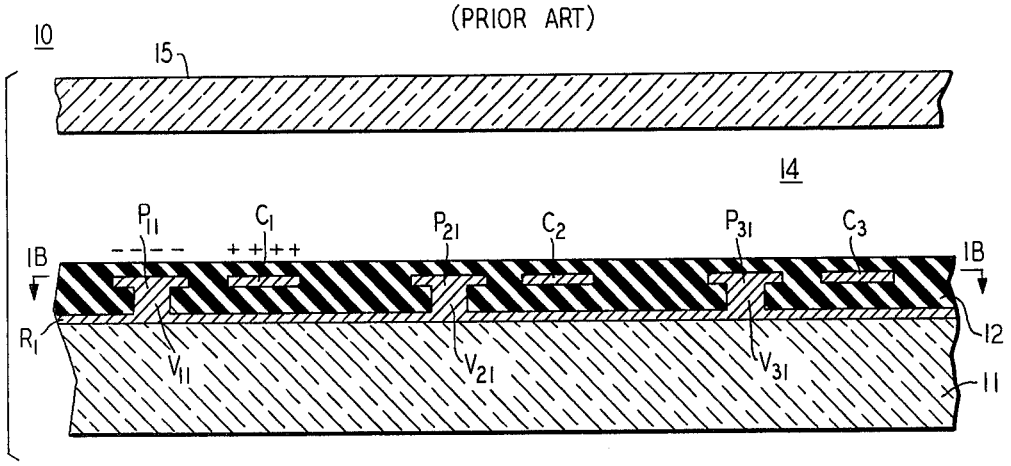
FIG. 1A (PRIOR ART)
FIGS. 1A and 1B depict a typical prior art planar ac plasma display device.
Figure 1B:
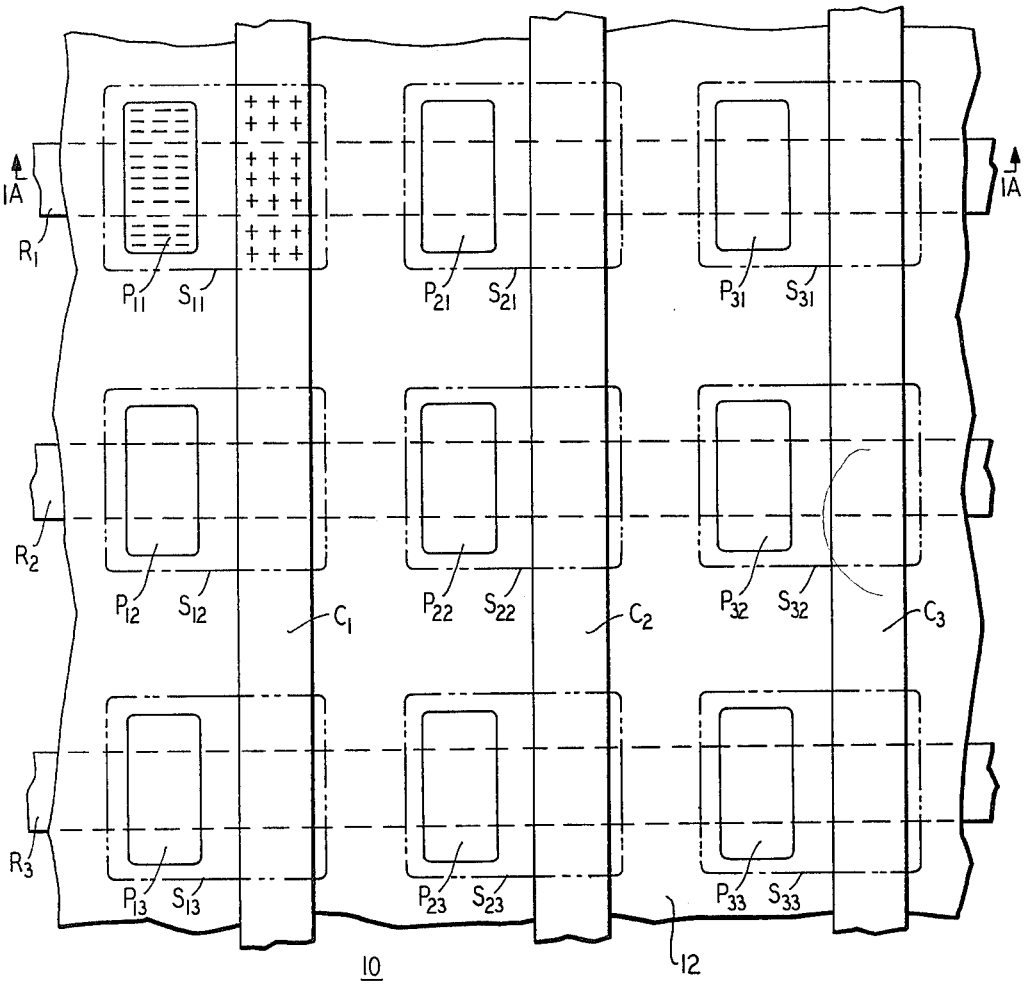
FIG. 1B (PRIOR ART)

FIGS. 1A and 1B show a portion of a single substrate planar ac plasma display panel 10 of a type known in the art. Panel 10 includes a substrate 11, which may be an eighth-inch glass plate, covered by a dielectric layer 12. (Cross-hatching of layer 12 has been eliminated in FIG. 1B for drawing clarity.) The dielectric of layer 12 is illustratively Electro Science Laboratories type M4111B vitreous black solder glass covered by a very thin film of $CeO_2$ or MgO. A plurality of metallic "column" conductors $C_i$, $i = 1, 2 \ldots N$ are embedded in layer 12 somewhat above substrate 11. Metallic pads $P_{ij}$, $j = 1, 2 \ldots M$, arranged in rows and columns, are also embedded in layer 12 at the same level as conductors $C_i$. The pads $P_{ij}$ in each row are electrically connected to one another by way of vias $V_{ij}$ which connect them to an associated one of metallic "row" conductors $R_j$.

Panel 10 further includes a glass cover plate 15 which is held away from the structure just described. Plate 15 is sealed around its periphery to provide a hermetic cavity within which a body of ionizable gas 14 is contained. The gas may be, for example, a mixture of neon and one-half percent argon at 500 torr.

The individual regions $S_{ij}$ in the vicinity of each pad $P_{ij}$ define a matrix of display sites, or cells. Information is displayed on the panel by creating individual glow discharges at selected sites in the display gas. This is achieved by applying appropriately timed and shaped voltage waveforms to pads $P_{ij}$ (by way of conductors $R_j$ and vias $V_{ij}$) and conductors $C_i$, illustratively under the control of a digital computer (not shown). Signal lead connections between the computer and conductors $C_i$ and $R_j$ may be made in standard fashion utilizing techniques and structures well known to those in the plasma display art.

One illustrative technique for fabricating the display device of FIGS. 1A and 1B includes the steps of screening conductors $R_j$ onto the surface of substrate 11 using, for example, thick film (e.g., 0.00025 inch) gold; screening a first portion of dielectric layer 12 over the substrate and conductors $R_j$ leaving 0.001 inch deep holes for vias $V_{ij}$; wiping a gold paste over the surface of the dielectric to fill in the via holes; screening pad $P_{ij}$ and conductors $C_i$ onto the dielectric surface, again using thick film gold and covering the above-described structure using a final 0.001 inch portion of dielectric followed by the thin film of $CeO_2$ or MgO. The cavity in which gas 14 is enclosed may then be formed by sealing all edges of cover plate 15 to the structure just described using 0.020 inch solder glass seal.

By way of example, consider display site $S_{11}$, which comprises the region in the vicinity of pad $P_{11}$ and conductor $C_1$. As indicated in waveform 21 in FIG. 2, a discharge is initiated as site $S_{11}$ by applying a write pulse WP between pad $P_{11}$ and conductor $C_1$ such as at time $t_1$. This creates an electric field within display gate 14 in the vicinity of site $S_{11}$. The magnitude $V_w$ of write pulse WP exceeds the minimum value $V_b$ necessary to ionize the gas along one or more flux paths in the vicinity of site $S_{11}$, $V_b$ being variously referred to as the "breakdown" or "striking" voltage. After a very short delay, known as the ionization time, a glow discharge characterized by a short, e.g., one microsecond, light pulse in the visible spectrum is initiated. The light pulse is represented as a narrow spike in waveform 23 of FIG. 2 occuring just after time $t_1$.

Write pulse WP may be generated by applying the voltages $+V_w/2$ and $-V_w/2$ to conductors $R_1$ and $C_1$, respectively. These two "half-select" signals are, of course, necessarily applied to all of sites $S_{il}$ and $S_{lj}$, respectively. However, since the two potentials $+V_w/2$ and $-V_w/2$ combine only at site $S_{11}$ in this example, only that site receives a full write pulse of magnitude $V_w$ and only thereat does a discharge occur.

In addition to a light pulse, a further concomitant of a glow discharge is the creation of a space cloud of electrons and positive ions in the vicinity of the display site. Write pulse WP, which continues to be applied to site $S_{11}$, pulls at least some of these electrons and ions to the upper surface, or wall, of dielectric layer 12. As schematically indicated in FIGS. 1A and 1B, the electrons are drawn to the area above pad $P_{11}$ and the ions are drawn to an area above conductor $C_1$. When write pulse WP terminates at time $t_2$, a "wall" voltage $e_m$ created by these so-called wall charge carriers remains stored at the display site, as indicated in waveform 22. This wall voltage plays an important role in the subsequent operation of the panel, as will be seen shortly.

A single short-duration light pulse cannot, of course, be detected by the human eye. In order to provide a plasma display site with the appearance of being continuously ligh-emitting (ON, energized), further rapidly-successive light pulses are needed. These are generated by a sustain signal which is impressed across each cell of the panel via its respective row and column conductor pair. As indicated in waveform 21, the sustain signal illustratively comprises a train of alternating positive- and negative-polarity sustain pulses PS and NS, respectively, which repeat every T seconds. The magnitude $V_s$ of these sustain pulses is insufficient to create a discharge. Thus, sites which have not received a write pulse remain in non-light-emitting states.

However, the electric field in the gas in the vicinity of a site which has received a write pulse, such as site $S_{11}$, comprises the superposition of the fields due to the sustain voltage and the wall voltage $e_m$ previously stored at that site. The sustain pulse which follows write pulse WP at time $t_3$ is a negative sustain pulse NS. Thus the wall and sustain fields combine additively and may be assumed to be sufficient in combination to create a second glow discharge and accompanying light pulse, occuring just after time $t_3$. The flow of carriers to the surface of layer 12 now establishes a wall voltage of opposite polarity. The arrival of the positive sustain pulse at time $t_4$ results in yet another discharge and wall voltage reversal, and so forth. The magnitude of wall voltage $e_m$ stabilizes at a nominally constant, characteristic level $V_m$ which is a function of the gas composition and pressure, electrode geometry, sustain voltage level, and other parameters. The wall voltage may attain $V_m$ immediately, i.e., in response to pulse WP, or, as shown in waveform 22, may build up to $V_m$ over one or more sustain cycles. (The principal determinants here are the magnitude, width and precise time occurrence of pulse WP.) The sustain signal frequency may be on the order of 50 kHz. Thus the light pulses of waveform 23 are fused by the eye of the viewer and site $S_{11}$ appears to be continuously energized.

Site $S_{11}$ is switched back to a non-light-emitting (OFF, de-energized) state by removing its wall charge. This is accomplished by applying an erase pulse EP to the site such as at time $t_5$, again via half-select signals applied to conductor pair $R_1$, $C_1$. The magnitude $V_e$ of pulse EP is sufficient to create a discharge in conjunction with the stored wall voltage, as the following positive sustain pulse PS would have. Wall voltage $e_m$ thus begins to reverse polarity. However, the magnitude and duration of erase pulse EP are such that the wall voltage reversal is terminated prematurely, at time $t_6$, when the wall voltage magnitude is near zero. Accordingly, no further discharges occur, and site $S_{11}$ returns to a non-light-emitting state. Any residuum of wall voltage $e_m$ eventually disappears due to recombination of the positive and negative charge carriers and diffusion thereof away from the display site.

Figure 3:
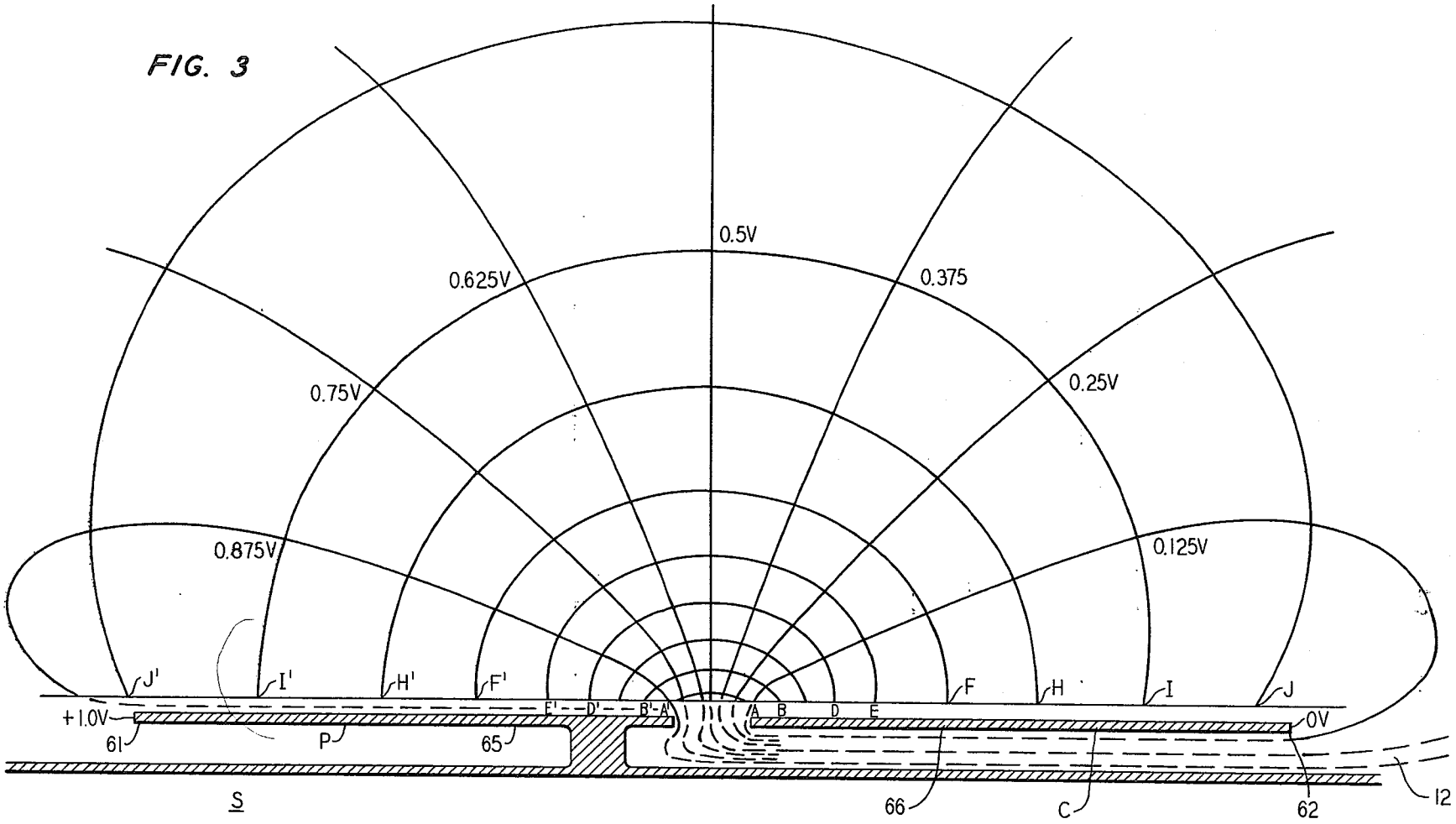
FIG. 3 depicts a planar ac plasma display site having elongated electrodes in accordance with the present invention.

FIG. 3 is an enlarged view of a planar ac plasma display site S. The electrode geometry of site S is similar to that of site $S_{11}$ of FIG. 1 except that pad P and conductor C of site S extend very much further away from the dielectric gap G between them than do pad $P_{11}$ and conductor $C_1$ of site $S_{11}$. (Here, again, crosshatching has been eliminated for drawing clarity.) FIG. 3 further shows the electric field resulting from write pulse WP during the above-mentioned ionization time, i.e., at an instant just prior to the initiation of any discharge. In FIG. 3, lines A—A', B—B', etc. represent approximately the flux lines, or flux paths, of the electric field, while the lines perpendicular thereto are approximate lines of equal potential, as marked. A consideration of FIG. 3 in conjunction with the curves of FIG. 4 will help explain the principles of the present invention.

Figure 4:
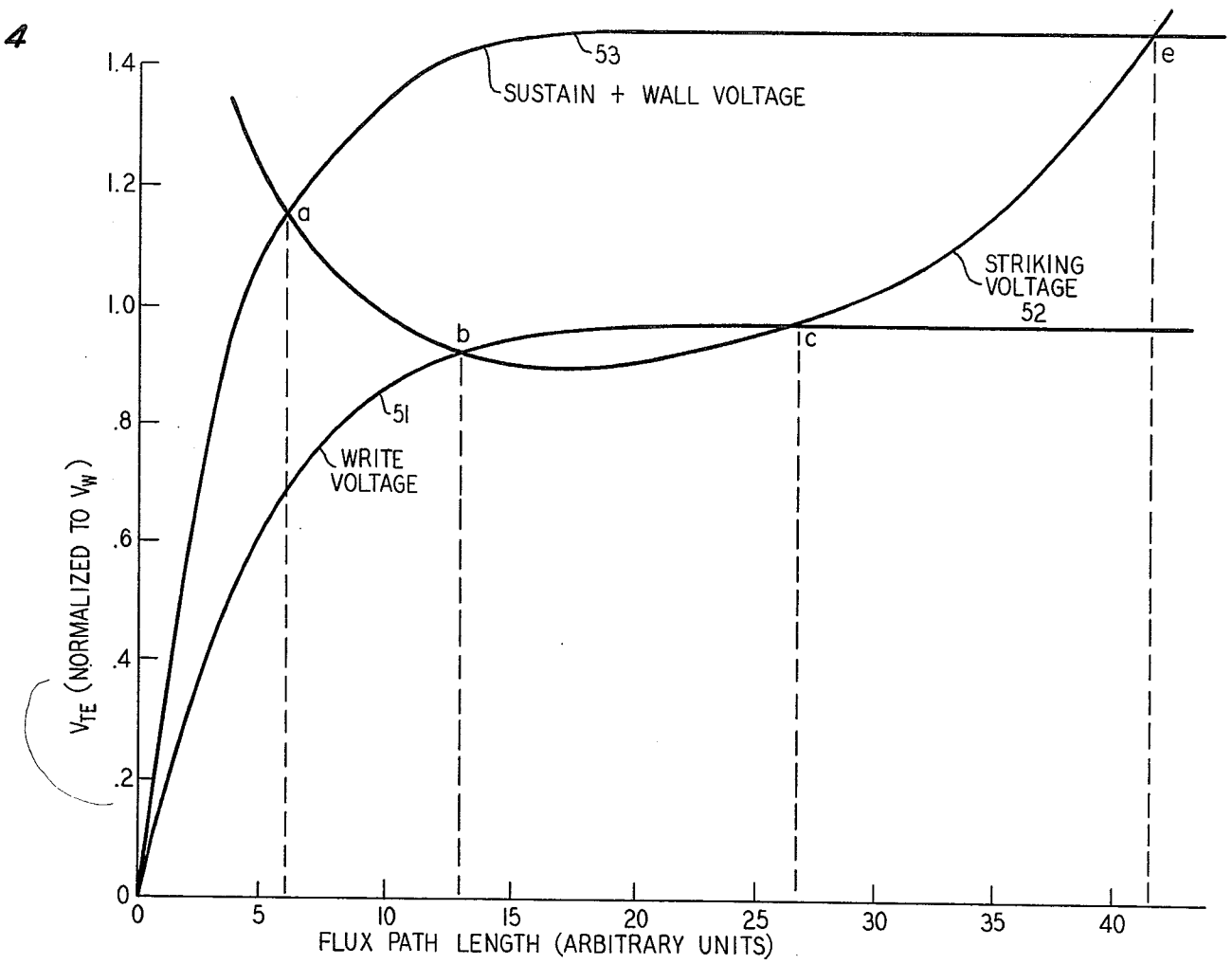
FIG. 4 is a graph helpful in explaining the principles of the present invention.

In FIG. 4, curve 51 represents the potential drop $V_{TE}$ along any of flux paths A—A', B—B', etc. as a function of flux path length (measured in arbitrary units) at the point in time just before a write-pulse-initiated discharge occurs, i.e., the point in time depicted in FIG. 3. Thus, for example, the drop across an individual one of paths A—A', B—B', etc. having a length of 10 units is approximately 0.85 $V_w$. Curve 51 rises monotonically and thereafter levels off at $V_w$. It may be assumed to continue at $V_w$ well beyond the 40 unit mark by assuming that the lengths of flux paths terminating at or beyond the end points 61 and 62 of pad P and conductor C, such as path J—J', are much greater than 40 units.

Curve 52 in FIG. 4 is a curve which shows the gas striking, or breakdown, voltage for site S. More particularly, this curve indicates for a flux path of any given length the minimum potential drop necessary to initiate a discharge along that path. Here, the fact that the ordinate of curve 51 exceeds the ordinate of curve 52 over the approximate range 13–26 units, as defined by intersection points b and d, indicates that the applied voltage of write pulse WP is sufficient to cause a discharge at the cell along flux paths within the 13–26 unit range. This may comprise, for example, a band of flux paths defined by paths B—B′ and D—D′ in FIG. 3. The glow, or light pulse, appears at the surface of dielectric layer 12 above conductor C since it is the cathodic electrode, more or less centered between points B and D.

The sustain pulse NS which follows write pulse WP is superposed with the wall voltage stored by the write pulse at the surface of layer 12, as previously discussed, to initiate another discharge. This time pad P is the cathodic electrode and the glow appears above it. As previously noted, the magnitude of the wall voltage $e_m$ is established at a steady-state value $V_m$ typically after several sustain cycles. The magnitude of the combined wall and sustain voltages is as much as 50 percent greater than the magnitude $V_w$ of write pulse WP. Accordingly, the potential drop along each flux path is also 50 percent greater, as indicated by curve 53 in FIG. 4. Accordingly, the glow can be expected to extend over a longer distance along the surface of layer 12, such as between points A and E and between points A′ and E′ for positive and negative sustain pulses, respectively, corresponding to intersections points a and e in FIG. 4. Due to the high frequency of the sustain signal, the successive discharges above pad P and conductor C are perceived by the viewer as a steadily glowing band of light extending between points E and E′.

It has heretofore been assumed in the art that the electric field created by the combined sustain and wall voltages remains centered at gap G throughout the discharge. This assumption, in turn, places a theoretical upper limit on the distance away from gap G that pad P and conductor C should be extended, since, as seen above, discharges for display site S would not be expected to extend beyond points E and E′, corresponding, again, to intersection point e in FIG. 4. Thus, the portion of pad P to the left of point 65 in FIG. 3, as well as the portion of conductor C to the right of point 66 would appear to be superfluous. Indeed, planar ac plasma panels heretofore known in the art have limited the distance that electrode pairs extend away from the gap between them in accordance with the above-discussed considerations.

Contrary to what has been heretofore assumed, however, I have discovered that the electric field created by the combined sustain and wall voltages does not remain centered at the interelectrode gap. Rather, it propagates further and further away from the gap along the cathodic electrode during each half cycle of the sustain waveform, discharging new regions of the gas as it goes and causing light to be emitted at points further and further along the electrode. I have thus discovered that a pair of electrodes in a planar ac plasma panel can be extended substantially further away from the dielectric gap between them than has been thought, thereby providing longer glow paths away from the gap than have been achieved heretofore.

Figure 5:
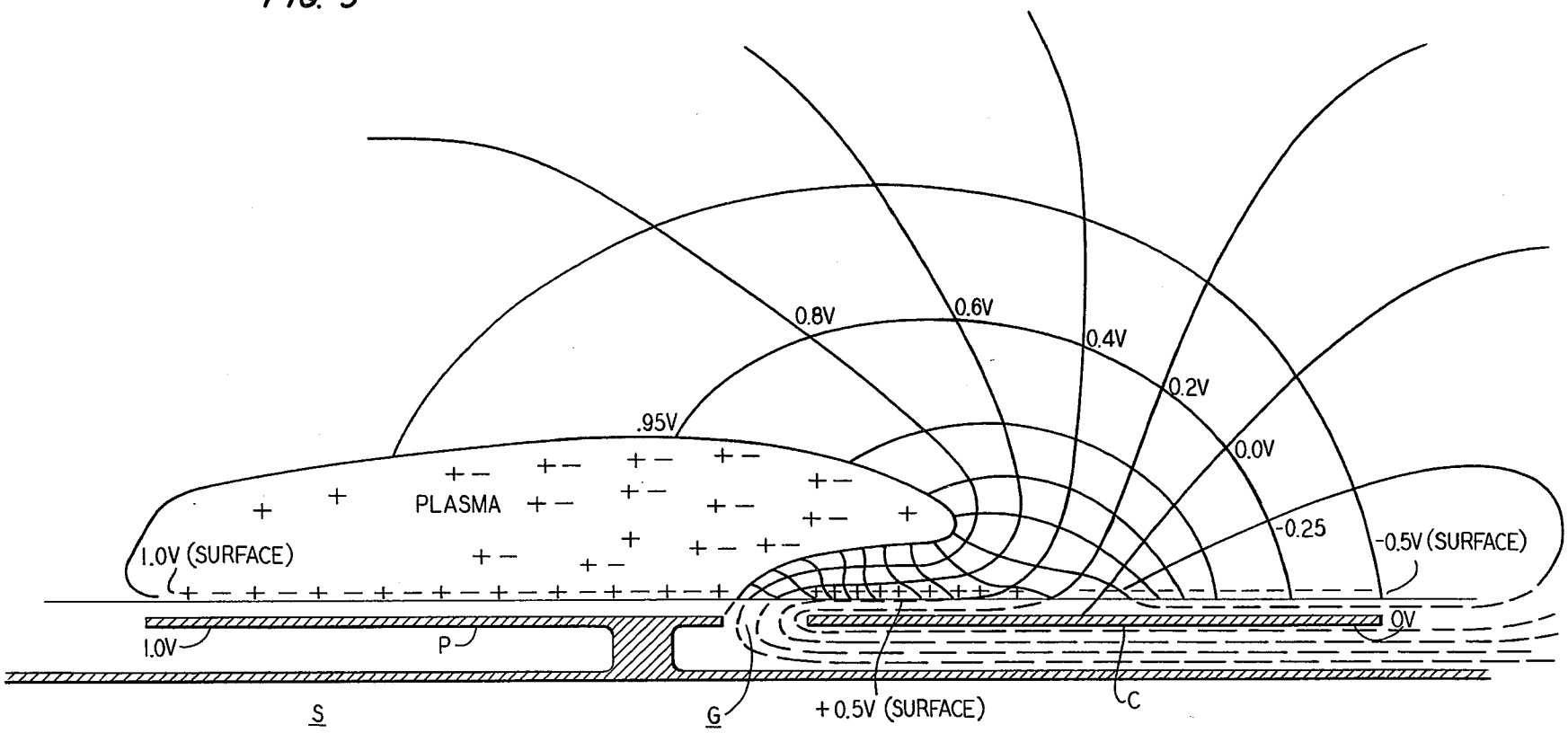
FIGS. 5 and 6 depict the display site of FIG. 3 in the ON state, each of these FIGS. helping to illustrate the glow propagation phenomenon which I have discovered.

FIG. 5, for example, shows site S in the ON state at a time soon after a positive sustain pulse PS has been applied to it. Wall charge electrons and positive ions were stored on the surface of layer 12 in response to the previous negative sustain pulse, and the present positive sustain pulse PS initiates a discharge more or less within a flux path band near gap G. The electrons on the surface of layer 12 near the gap have quickly begun to move toward pad P. The ions near the gap are much heavier and move much more slowly. As a result, a plasma of electrons and ions forms in the gas in the vicinity of pad P. (The outline of the plasma in FIG. 5 is only an approximation; its actual size and shape are not known precisely.) The plasma region is, in essence, a gaseous conductor the presence of which negates the existence of any substantial electric field gradient in the vicinity of pad P. Thus, as electrons are drawn toward pad P by the positive potential thereon, they distribute themselves more or less uniformly on the surface of layer 12 above the pad. On the other hand, when positive ions reach the region above conductor C, they do not distribute themselves uniformly on the surface of layer 12 because there is little plasma above conductor C. Rather, substantial field gradients continue to subsist in the region of conductor C and thus the ions are drawn to the high field region near gap G. As also seen in FIG. 5 some electrons from the original wall charge remain toward stored above conductor C to the right of the recently-arrived ions. These electrons have yet to move substantially because the flux paths on which they lie have yet to satisfy the striking voltage criterion of curve 52 in FIG. 4.

Figure 6:
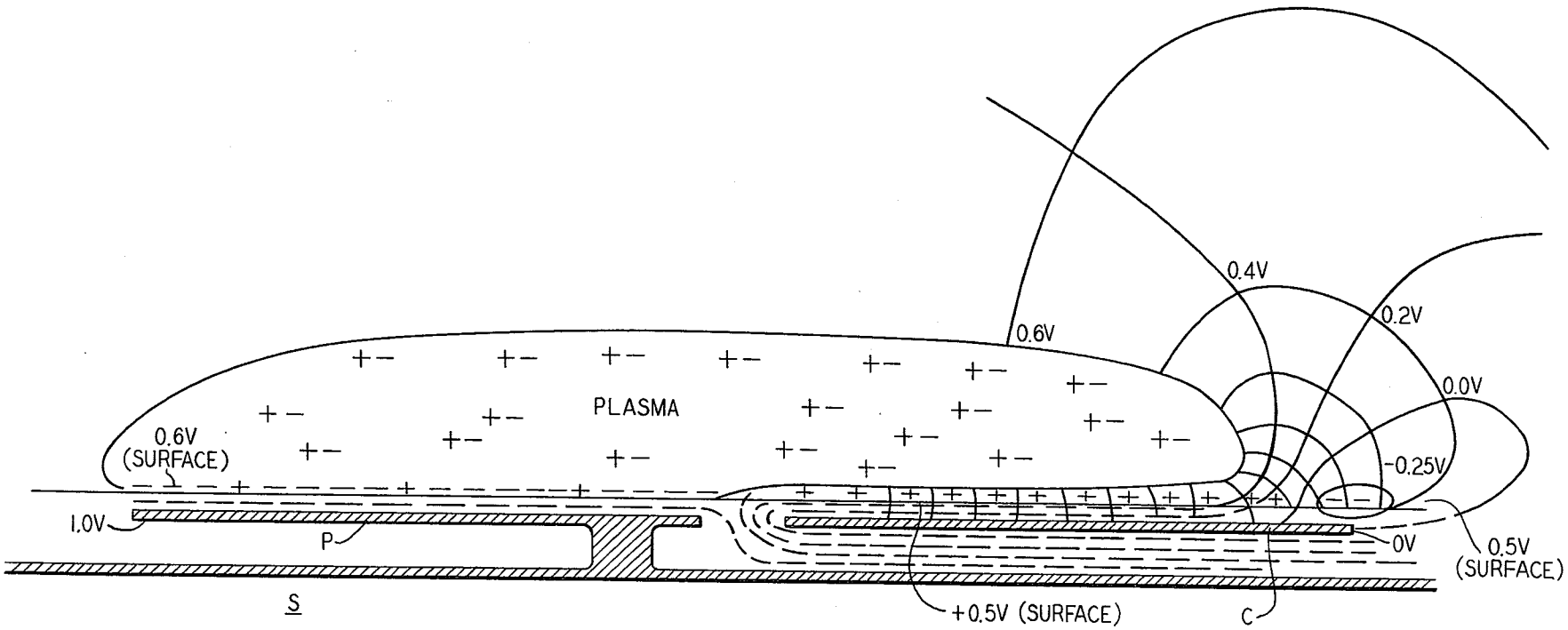

I have discovered that at least two factors operate to change this picture, however. Since the plasma is essentially a conductor, it brings the positive potential of pad P closer to the heretofore unmoved electrons. That potential, furthermore, is augmented by the positive ions stored above conductor C. As a result, additional flux paths now satisfy the striking voltage criterion of curve 52. Further discharges occur, the leftmost electrons above conductor C now accelerating toward the plasma creating a momentary glow above conductor C as they leave. These electrons are replaced by ions, and the center of the electric field moves further to the right. The limits of the plasma also move to the right, however, creating more discharges further along conductor C, as shown in FIG. 6.

Ultimately, the field begins to collapse as more and more ions are drawn to and are stored above conductor C and, at the same time, more and more electrons are drawn to pad P out of the plasma. The field stops propagating when its strength is so reduced that further discharges cannot occur (as governed by curve 52). This may happen only when the center of the field reaches the end of conductor C; I have observed propagation for distances of several hundred times the width of gap G.

During the next half cycle of the sustain signal, the above-described roles of pad P and conductor C reverse. The overall effect then is an elongated band of light extending between the end points of pad P and conductor C.

Figure 7A:
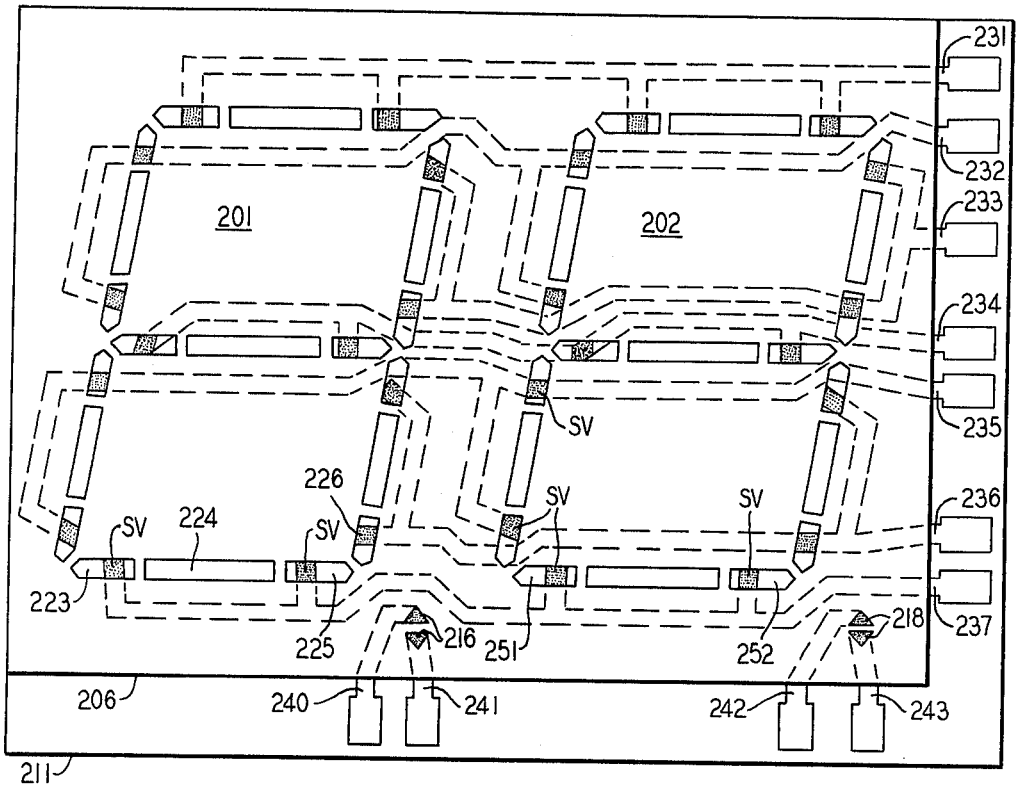
FIGS. 7A–7C depict a two-digit display device embodying the principles of the present invention.
Figure 7B:
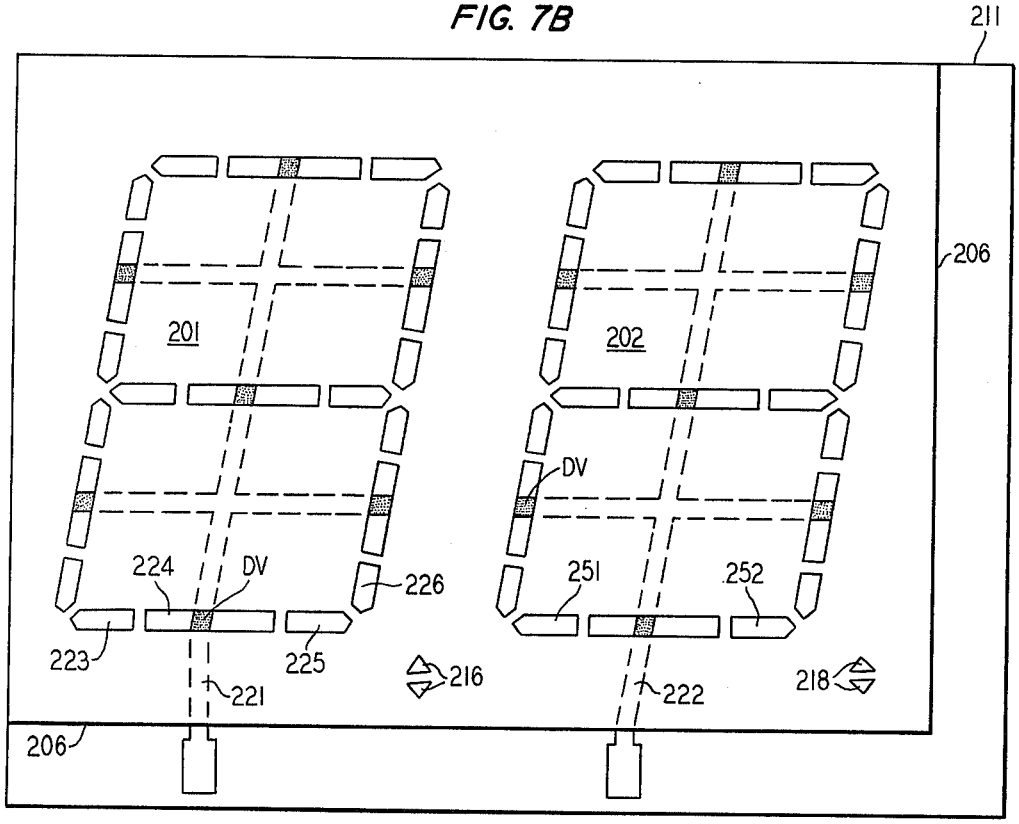
Figure 7C:
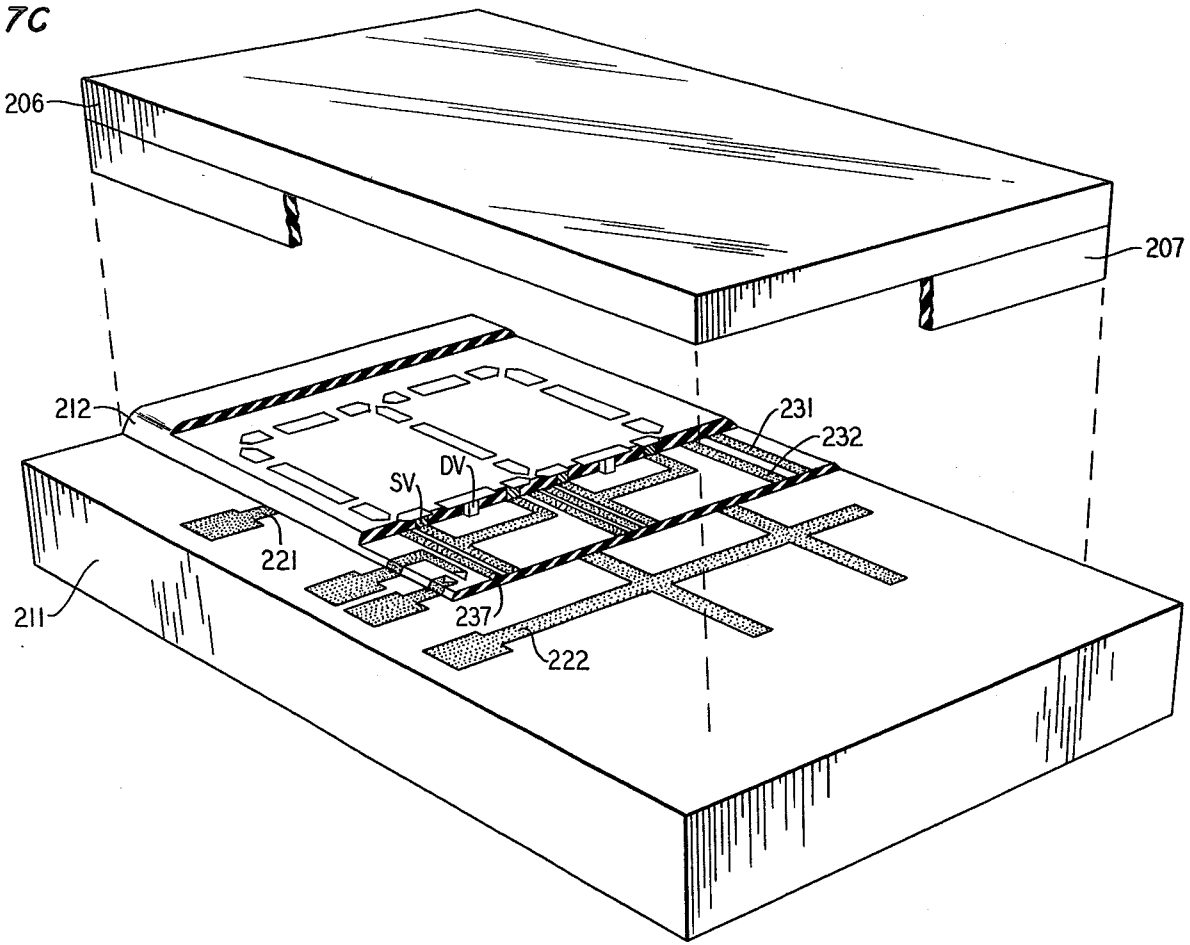

FIGS. 7A–7C depict an illustrative two digit display device which takes advantage of the above-described glow propagation phenomenon in accordance with the present invention. (Here, again, some cross-heating has been eliminated, and some of the dimensions have been exaggerated for clarity.) The two digits of the display, indicated generally at 201 and 202, are each comprised of seven segments arranged to form two contiguous quadralaterals, i.e., a block figure eight. Each segment, in turn, is comprised of a set of three collinear metallic electrode bars—a central "digit" bar and two outer "segment" bars. The bottom-most bar of digit 201, for example, is comprised of digit bar 224 and segment bars 223 and 225. All of the bars are embedded at a single level within a dielectric layer 212. The latter, in turn, is disposed on a glass substrate 211. A glass cover plate 206 encloses a body of display gas (not shown) between itself and layer 212, plate 206 being held away from layer 212 by conventional solder glass seal 207.

Connections are made between each digit and segment bar and external signal sources by way of conductor paths, or leads, disposed at two different levels within layer 212. The two conductor levels can be seen together in the cutaway, partially exploded perspective view of FIG. 7C and individually in the plan views of FIGS. 7A and 7B. In particular, seven metallic vias DV (shown stippled for clarity) extending through layer 212 each connect a respective digit bar of digit 201 to digit lead 221. Similarly, vias connect the seven digit bars of digit 202 to digit lead 222. Illustratively, digit leads 201 and 202 are each disposed at the layer 212/substrate 211 interface.

The two segment bars associated with each segment of a digit are connected both to each other and to the corresponding two segment bars of the other digit by way of a respective one of segment leads 231-237. Thus, for example, segment bars 223 and 225 of digit 201 and segment bars 251 and 252 of digit 202 are all connected by way of respective vias SV (stippled for clarity) to segment lead 237. Segment leads 231-237 are disposed within layer 212 somewhat above digit leads 221 and 222. Two pairs of decimal point bars 216 and 218 are also connected by way of vias to respective lead pairs 240/241 and 242/243, which are disposed within layer 212 at the same level as segment leads 231/237.

Cover plate 206 is somewhat smaller than substrate 211, thereby allowing leads 221, 222, 231–237 and 240–243 to extend outside the hermetic cavity to respective contact pads disposed on the surface of substrate 211. The edges of layer 212 are sloped, so that leads 231–237 and 240–243 are easily fabricated to follow the contour of that edge down to the substrate surface.

Figure 2:
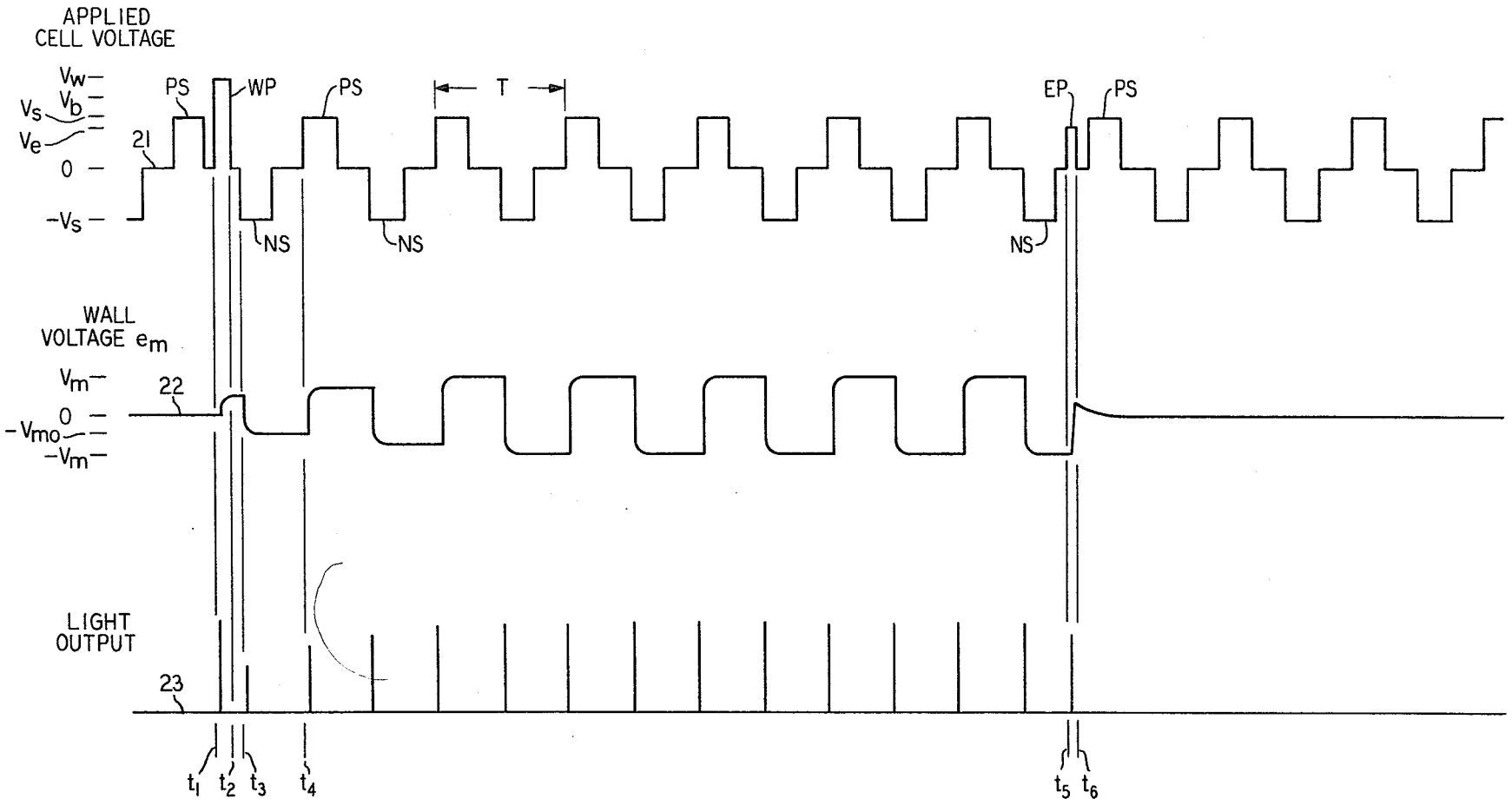
FIG. 2 depicts signal waveforms helpful in explaining the operation of the display device of FIGS. 1A and 1B.

In operation, a sustain signal such as the train of positive and negative pulses PS and NS shown in FIG. 2 is imposed between digit leads 221 and 222, on the one hand, and segment leads 231–237 on the other hand. Since the segment bars of each digit receive the same polarity of sustain signal at the same time, discharges cannot occur between adjacent segment bars of different segments, e.g., bars 225 and 226 of digit 201, thereby eliminating a possible source of crosstalk between adjacent segments.

Again, the magnitude $V_s$ of the sustain pulses is such that the resulting electric fields centered at each digit bar/segment bar gap are insufficient to create any discharges. However, a particular segment is caused to glow, i.e., is switched to the ON state, by applying the half-select portions of a write pulse, such as pulse WP, to its associated digit and segment leads, respectively. For example, the bottom-most segment of digit 201 comprising bars 223-225 is switched to the ON state by applying the voltages $+V_w/2$ and $-V_2/2$ to digit lead 221 and segment lead 237, respectively. This creates initial discharges and stores wall charge in the vicinity of the gap between bars 223 and 224 and in the vicinity of the gap between bars 224 and 225. The subsequent sustain pulses combine with the stored wall charge to cause successive discharges during which the electric fields propagate out to the ends of bars 223 and 225 for one polarity of sustain pulse and in toward the center of bar 224 for the other polarity of sustain pulse. The gaps are sufficiently narrow that the glows coalesce thereover and the overall effect is of a glowing band covering all three segments. It may be noted in this regard that the metallic area of each digit bar should be substantially equal to the total metallic area of its associated segment bars to ensure that the glows do, in fact, spread to the outer ends of the segment bars and to the center of the digit bar.

Other segments of digits 201 and 202 can be similarly switched to the ON state by applying half-select voltages to the appropriate digit and segment leads. The sustain signal maintains each segment which has received a write pulse in the ON state indefinitely, thereby advantageously providing a display which does not require periodic application of information-bearing update, or refresh, information. A particular segment can be returned to an OFF state at any time, however, by applying halfselect portions of an erase pulse, such as pulse EP, to its digit and segment leads.

The decimal points of the display similarly receive sustain, write and erase pulses by way of their respective signal lead pairs.

In an alternative embodiment of a display comprising seven-segment digits, each segment can be comprised of one digit bar and one segment bar, the bars being of equal lengths. The digit and segment line interconnections are such that the bars meeting at each segment intersection, i.e., each corner of the figureeight, are of the same type. Again, this ensures that the bars at each intersection receive the same polarity of sustain signal, eliminating what might otherwise be a source of crosstalk between adjacent segments. The two-bar-per-segment display operates on the same principles as the three-bar-per-segment display of FIGS. 7A–7C, described above.

Figure 8:
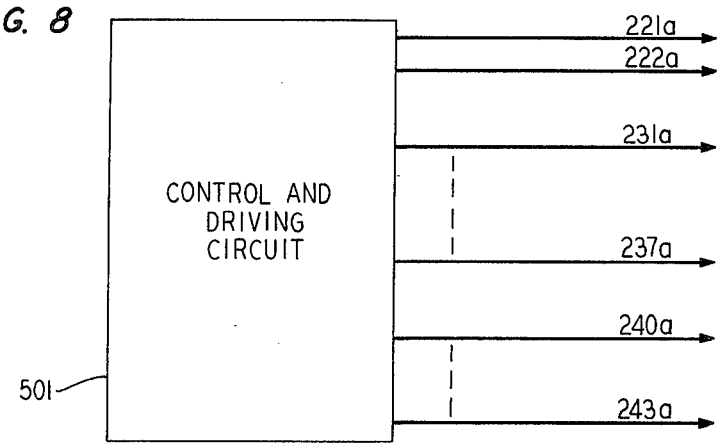
FIG. 8 symbolically depicts sustain and drive circuitry for the device of FIGS. 7A–7C.

Circuitry for applying sustain, write and erase signals to leads 221, 222, 231–237 and 240–243, as described above, is symbolically represented by control and driving circuit 501 in FIG. 8. Output leads 221*a*, 222*a*, 231*a*–237*a*, and 240*a*–243*a* of circuit 501 are connected to leads 221, 222, 231–237 and 240–243, respectively. Circuit 501 itself may be similar to any of numerous plasma panel control and driving circuits known in the art such as those disclosed in my U.S. Pat. No. 3,689,912 issued Sept. 5, 1972, which is hereby incorporated by reference. In particular, leads 221*a*, 222*a*, 240*a* and 242*a* in FIG. 8 hereof may be output leads of drivers such as the row drivers disclosed in the U.S. Pat. No. 3,689,912, while leads 231*a*–237*a*, 241*a* and 243*a* may be the output leads of drivers such as the column drivers of that patent.

The display device of FIGS. 7A–7C may be fabricated in a manner similar to that described hereinabove for the display device of FIGS. 1A and 1B by screening conductors 221 and 222 onto substrate 211', screening a portion of dielectric layer 121 over those conductors and the substrate, leaving holes for the bottom portions of vias DV; filling in the holes with gold paste; screening conductors 231–237 and 240–243 onto the dielectric; screening another portion of dielectric layer 212, leaving holes for vias SV and for the upper portions of vias DV; filling in these holes with gold paste; screening the digit, segment and decimal point bars; covering these with a final portion of dielectric followed by the thin film of $CeO_2$ or MGO and sealing cover plate 215 around the periphery of the device using glass solder seal.

Figure 9A:
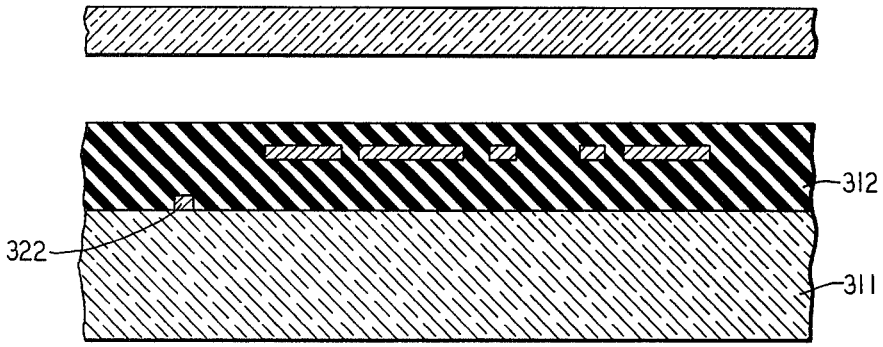
FIGS. 9A and 9B depict a fixed-format display device embodying the principles of the present invention.
Figure 9B:
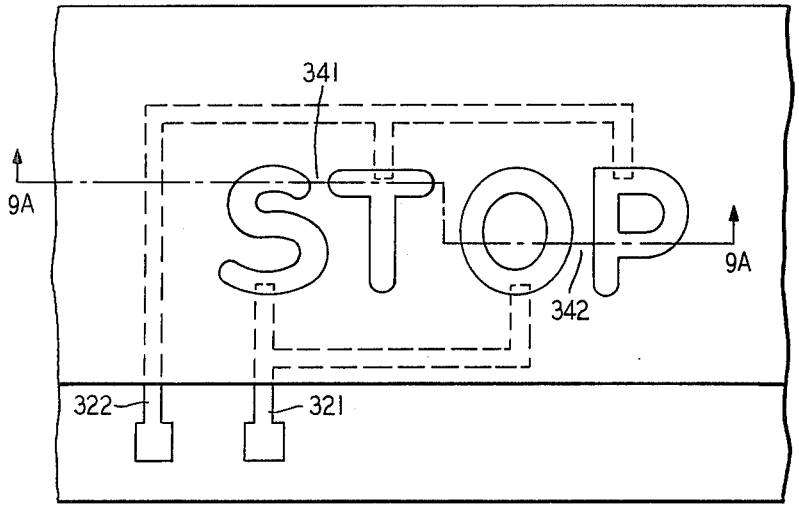

FIGS. 9A and 9B show another embodiment of a display device in accordance with the present invention. Here, individual electrodes forming the letters S, T, O and P are disposed within a dielectric layer 312 on a substrate 311. The S and O electrodes are connected by way of respective vias to lead 321. The T and P electrodes are similarly connected to lead 322. Leads 321 and 322 are illustratively disposed at the substrate/-dielectric layer interface.

The arrangement of FIGS. 8A and 8B is a so-called fixed-format display in which the display sites are either all OFF or all ON. The display may be thought of as comprising two, two-electrode plasma discharge display sites. The first discharge site comprises the S and T electrodes having between them a gap 341. The second comprises the O and P electrodes having between them a gap 342.

In operation, a pulse sufficient to cause discharges in the vicinities of gaps 341 and 342 is applied between leads 321 and 322. Subsequent sustain pulses applied between these conductors cause wall charge to be stored at the surface of dielectric layer 312 above the entire lengths of the four electrodes. Thus, the electric field created in response to each sustain pulse, added to the field due to the wall voltage, propagates along the cathodic electrode during alternate half cycles to create the impression of a continuous glow above each character electrode.

The electrodes of each display site should be of substantially equal areas to ensure that each character is fully displayed. Slight differences in area can be compensated for by utilizing a somewhat larger-than-usual sustain voltage level. If desired, such an increased sustain voltage level, rather than a separate write pulse, can be the mechanism by which the initial discharge is created. The display is returned to the OFF state simply by interrupting the sustain signal for sufficient time for the stored wall charges to recombine with free charges in the main body of the gas.

Figure 10A:
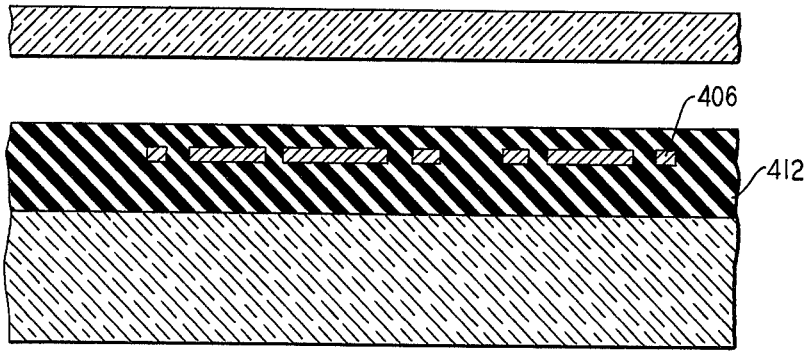
FIGS. 10A and 10B depict another fixed-format display device embodying the principles of the present invention.
Figure 10B:
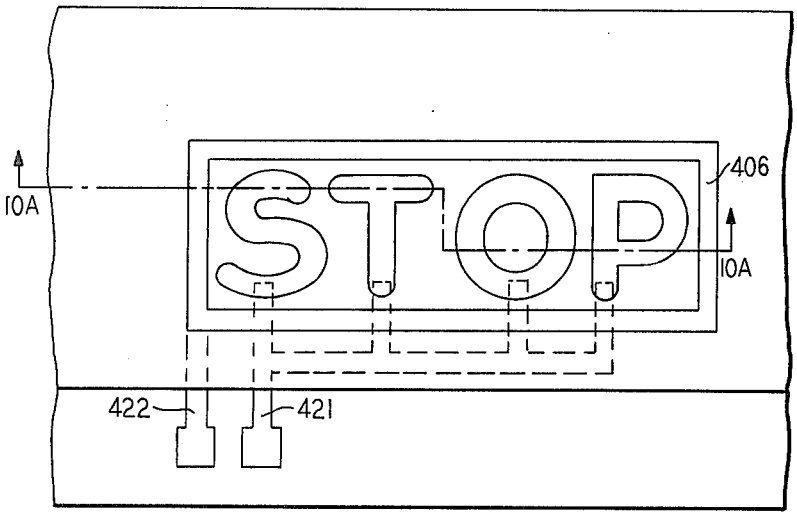

Another fixed-format display in accordance with the invention is shown in FIGS. 10A and 10B. Here the four character bars, embedded in dielectric layer 412, are all connected together by way of vias to lead 421 to form a first electrode. A metallic rectangular ring 406 is embedded at the same level of dielectric layer 413 to form the second electrode. Ring 406 is connected by way of a via to lead 422. Ring 406 is sufficiently proximate to each character electrode to ensure that a write pulse, for example, applied between leads 421 and 422 will cause a discharge between the ring and each character electrode. Thereafter, the glow propagation phenomenon previously described causes the gas above each character and above ring 406 to glow in response to subsequent sustain pulses. Again, the area of ring 406 may advantageously be made substantially equal to the total area of the character electrodes to ensure that each character glows fully.

The display devices of FIGS. 9A, 9B, 10A and 10B may both be driven by circuitry similar to that described above in connection with the device of FIGS. 7A–7C.

Although specific embodiments of the present invention have been shown and described herein, it will be appreciated that many and varied arrangements embodying the principles of the invention may be devised by those skilled in the art without departing from the spirit and scope of the invention.

What is claimed is:

1. Display apparatus comprising, a body of ionizable gas, a dielectric layer adjacent said gas, at least first and second elongate electrodes embedded in said layer, said electrodes being separated by a gap comprising a region of said layer, and signal means for creating a series of glow discharges in said gas in the vicinity of said electrodes, said signal means including means for establishing in said gap a series of electric fields initially centered at said gap, individual flux lines of each field having potential drops which exceed the gas striking voltages respectively associated with those lines.

characterized in that at least a portion of each of said electrodes is located substantially further away from said gap than is any point on the longest of said lines.

2. The invention of claim 1 wherein said signal means includes means for applying to said electrodes a write signal of sufficient magnitude and duration to create an initial glow discharge in the vicinity of said electrodes and to store a first level of charge thereat, and means for repetitively applying to said electrodes alternating polarity sustain signals of predetermined duration and magnitude, said sustain signals causing a characteristic level of charge to be stored in the vicinity of said electrodes in response to the storage of said first level of charge thereat, each said electric field comprising the superposition of the fields due to said characteristic level of stored charge and an individual one of said sustain signals.

3. The invention of claim 2 wherein said electrodes are substantially collinear.

4. Invention of claim 2 wherein at least one of said electrodes is formed in the shape of an alphanumeric character.

5. The invention of claim 2 wherein the surface areas of said first and second electrodes are substantially equal.

6. Display apparatus comprising, a body of ionizable gas, a dielectric layer adjacent said gas, at least first and second elongate electrodes embedded in said layer, said electrodes being separated by a gap comprising a region of said layer, and means for receiving predetermined input signals adapted to establish in said gas a series of electric fields initially centered at said gap, individual flux lines of each field having potential drops which exceed the gas striking voltages respectively associated with those lines so that a series of glow discharges is created in said gas in the vicinity of said electrodes, characterized in that at least a portion of each of said electrodes is located substantially further away from said gap than is any point on the longest of said lines.

7. The invention of claim 6 wherein said predetermined input signals comprise a write signal of sufficient magnitude and duration to create an initial glow discharge in the vicinity of said electrodes and to store a first level of charge thereat, and a plurality of alternating polarity sustain signals of predetermined duration and magnitude, said sustain signals causing a characteristic level of charge to be stored in the vicinity of said electrodes in response to the storage of said first level of charge thereat, each said electric field comprising the superposition of the fields due to said characteristic level of stored charge and an individual one of said sustain signals.

8. The invention of claim 7 wherein said electrodes are substantially collinear.

9. Invention of claim 7 wherein at least one of said electrodes is formed in the shape of an alphanumeric character.

10. The invention of claim 7 wherein the surface areas of said first and second electrodes are substantially equal.

11. Display apparatus comprising, a nonconductive substrate, a layer of dielectric material disposed on said substrate, a body of ionizable gas, a nonconductive cover plate, means for sealing said cover plate to said layer to entrap said body of gas therebetween, a plurality of sets of elongate electrodes all embedded at substantially the same level within said layer, each set of electrodes comprising a central electrode and a pair of outer electrodes substantially collinear with said central electrode, and means for interconnecting each outer electrode to the other outer electrode of the same set.

12. In invention of claim 11 wherein said sets of electrodes are arranged in first and second groups, each set in said first group having a corresponding set in said second group, and wherein said interconnecting means includes means for interconnecting the outer electrodes of each set of said first group with the outer electrodes of the corresponding set of said second group.

13. The invention of claim 12 further comprising means for interconnecting the central electrodes of the sets of said first group and means for interconnecting the central electrodes of the sets of said second group.

14. The invention of claim 13 wherein each of said groups includes at least seven of said sets of electrodes arranged to form two contiguous quadralaterals.

15. The invention of claim 11 wherein said display apparatus is so arranged that individual ones of a predetermined train of pulses applied between an individual one of said central electrodes and at least an individual one of the outer electrodes of the same set will each create a glow discharge in said gas and will cause a characteristic level of charge to be stored on the surface of said layer, each of said individual ones of said pulses combining with the charge stored by a previous one of said pulses to establish in said gas an electric field initially centered between said individual one of said central electrodes and said individual one of said outer electrodes, a plurality of flux lines of said field having potential drops which exceed the gas striking voltages respectively associated with those lines, and wherein at least a portion of said individual outer electrode is located further away from said individual central electrode than is any point on the longest of said field lines.

* * * * *